US005588758A

United States Patent [19]

Yamamoto

[11] Patent Number: 5,588,758

[45] Date of Patent: Dec. 31, 1996

[54] SHEET FEEDING APPARATUS

[75] Inventor: Shinji Yamamoto, Tokyo, Japan

[73] Assignee: Canon Kabushiki Kaisha, Tokyo, Japan

[21] Appl. No.: 483,863

[22] Filed: Jun. 7, 1995

Related U.S. Application Data

[62] Division of Ser. No. 80,710, Jun. 24, 1993, abandoned.

[30] Foreign Application Priority Data

Jun. 25, 1993 [JP] Japan ..... 4-167943

[51] Int. Cl.[6] ..... B41J 19/30

[52] U.S. Cl. ..... 400/322; 400/76; 400/279

[58] Field of Search ..... 400/322, 279, 400/320, 323, 54, 76, 283

[56] References Cited

U.S. PATENT DOCUMENTS 5,431,502 7/1995 Orii et al. ..... 400/322

FOREIGN PATENT DOCUMENTS

| | | |
|---|---|---|
| 351854 | 1/1990 | European Pat. Off. . |
| 369331 | 5/1990 | European Pat. Off. . |
| 0385409 | 9/1990 | European Pat. Off. . |
| 436336 | 7/1991 | European Pat. Off. . |
| 437319 | 7/1991 | European Pat. Off. . |
| 450962 | 10/1991 | European Pat. Off. . |
| 0471495 | 2/1992 | European Pat. Off. . |
| 2-030572 | 1/1990 | Japan . |

*Primary Examiner*—Christopher A. Bennett

*Attorney, Agent, or Firm*—Fitzpatrick, Cella, Harper & Scinto

[57] ABSTRACT

The printing apparatus or the sheet feeding apparatus disclosed here which employs vibration driven actuators as driving sources has a circuit for detecting the characteristics of the actuator during preparatory operation performed previous to the regular operation. Information detected by said circuit is used to control the actuators during the regular operation. As a result, a printing apparatus or a sheet feeding apparatus capable of reducing wasteful or unnecessary operation can be obtained.

5 Claims, 5 Drawing Sheets

SHEET FEEDING APPARATUS

This application is a division of application Ser. No. 08/080,710, filed Jun. 24, 1993, now abandoned.

BACKGROUND OF THE INVENTION

1. Field of the Invention

The present invention relates to a printing apparatus having ultrasonic actuators serving as power sources for reciprocating a carriage and feeding a sheet.

2. Related Background Art

Conventionally, an apparatus having a construction shown in FIG. 2 has been known as a thermal jet type printing apparatus employing ultrasonic actuators as power sources.

In FIG. 2, referential numerals 5 and 8 denote typical ultrasonic actuators. As shown in FIG. 3, the ultrasonic actuator 5 consists of a radial fin type elastic member 12 having a pair of linear portions and a pair of arcuate portions and a piezoelectric element 13 fixed to the elastic member. When the piezoelectric element 13 is applied with plural kinds of AC voltage having phases electrically different from each other, in order to generate travelling vibration over the surface of the elastic member 12, a carriage 19 including a printing head 4 is shifted by a slider 1 which is in contact with the surface of the elastic member 12. A linear guide 7 guides the carriage 19.

A sheet 11 on which printing is performed is transferred by the ultrasonic actuator 8, which is the same as the ultrasonic actuator 5. In fact, as shown in FIG. 4, both sides of the sheet 11 are appropriately pressure-welded, that is, pinched by a pair of ultrasonic actuators 8 and 8'. In FIG. 4, crests of both travelling waves generated over the elastic member surfaces of respective ultrasonic actuators 8 and 8' concur with each other, and the travelling waves are controlled to travel to the same direction with respect to the sheet 11. At this time, specific mass points on the elastic member surfaces of the actuators more elliptically as 8*a* and 8'*a* in the figure. Due to such elliptical motion, the sheet 11 is transferred toward the direction opposite to that of the travelling waves.

A support plate 3 supports the upper actuator 8, which is one of the ultrasonic actuators 8 and 8' for feeding the sheet. A rotary encoder 9 which is connected with a roller 9*a* pressure-welded onto the sheet and is rotated therewith detects the shifting amount of the sheet. A sheet guide 10 along which the sheet is slid and carried to prevent the sheet from slanting. A linear encoder 6 for the carriage optically detect the shifting amount and the position of the carriage to determine timing for the printing head 4 to discharge ink. A home position sensor 2 is used to determine the absolute position of the printing head from the home position, wherein the carriage is generally moved to the position of the home position sensor when power is applied. The count value of the linear encoder is cleared at that position, and after that, the position of the carriage including the printing head is regulated relatively on the basis of the value detected by the linear encoder 6.

FIG. 5 shows the control circuit for the ultrasonic actuator(s).

In the figure, an oscillator 14 generates pulses according to the multitude of DC voltage, a ring counter 16 determines one of outputs $\phi_1$ to $\phi_4$ to be switched on in turn according to the output of the oscillator 14 serving as a clock, switching transistors 17*a* to 17*d* perform switch-on/off operation according to the output of the ring counter 16, and a center tap type transformers 18*a* and 18*b* generates increased secondary AC waves according to the switch-on/off operation performed by the switching transistors. The phases of the outputs of the transistors 17*a* and 17*b*, as well as those of the outputs of the transistors 17*c* and 17*d*, are shifted from each other by 180°, while the phases of the transistors 17*a* and 17*c*, as well as those of the transistors 17*b* and 17*d*, are shifted from each other by 90°. Accordingly, the transformers 18*a* and 18*b* output secondary AC waves having phases shifted from each other by 90°. As understood from the above construction, the frequency of the secondary outputs from the transformers is ¼ of the frequency of the oscillator 14. Ultrasonic actuators 5, 8 and 8' are driven by applying two kinds of properly increased voltage having two phases shifted from each other by 90°. Though only one ultrasonic actuator is shown in FIG. 5, actually three actuators are provided in the printer shown in FIG. 2, wherein they are used to drive the carriage and feed the sheet. The three actuators may be controlled by using corresponding three circuits similar to that shown in the figure. Otherwise, they may be controlled by switching the outputs of the circuit shown above. An encoder 20 corresponds to the linear encoder 6 and the rotary encoder 9 shown in FIG. 2. On the basis of the output of this encoder 20, in order to obtain stable speed, the value of the frequency designated to the oscillator 14 is controlled by a controller 15, which comprises, for example, a microcomputer. FIG. 6 shows relation of shifting speed of the carriage to the frequency of driving voltage applied to the ultrasonic actuator 5 for driving the carriage. In FIG. 6, fr is the resonance frequency of the ultrasonic actuator, at which the shifting speed of the carriage is maximal. As is clearly understood from the graph, as the driving frequency decreases from 46 kHz, the speed of the carriage gradually increases. Below fr, however, the speed of the carriage suddenly decreases. That is, because of the reversion from increase to decrease of the speed of the carriage at fr with respect to decrease of the frequency, the frequency should be always higher than fr in order to smoothly control the speed.

The conventional printing apparatus having the above-mentioned construction has the following problems.

As the resonance frequency is not always the same but varies depending on changes in characteristics such as temperature and other environment factors, the characteristic curve shown in FIG. 6 may shift horizontally. Therefore, the speed varies even when the carriage is driven at the same frequency, and may suddenly decrease when the resonance frequency becomes higher than the driving frequency.

In order to always obtain stable operation of the printer regardless of the above-mentioned characteristics, it is necessary to detect the characteristics of the speed with respect to the driving frequency under the operational environment in advance. When operation to detect the characteristics is performed independent of actual print operation by the printer, however, loss of time or unnatural print operation may occur. An additional circuit for knowing the characteristics would increase cost.

SUMMARY OF THE INVENTION

In one aspect of the present invention, the control means for the ultrasonic actuators is/are constructed so as to detect the characteristics of the ultrasonic actuators during the preparatory operation during which the printing head and the print sheet are positioned at the reference positions (home positions) previous to the actual print operation performed by the printing apparatus. Thus, operations of the ultrasonic actuators in the print operation are controlled on the basis of the characteristics detected during the preparatory operation. Detection of the characteristics of the ultrasonic actuators during the preparatory operation can be performed by a known detection means, while control of the ultrasonic actuators in actual print operation on the basis of the detected characteristics can be performed by improving functions of the microcomputer contained in said control means. Therefore, an external circuit for characteristic detection, or the like need not be added.

In another aspect of the present invention, during operation for cleaning the printing head performed previous to regular operation of the printer, the characteristics of the ultrasonic actuators or vibration driven actuators are detected. And operation of the actuators in regular print operation is controlled on the basis of the result of the detection.

Other aspects of the present invention will be clearly understood from the following detailed description of the present invention.

DESCRIPTION OF THE PREFERRED EMBODIMENTS

Now, embodiments of the thermal jet type printing apparatus improved according to the present invention will be described with reference to FIGS. 1 to 8. Incidentally as the construction of the printing apparatus according to the present invention is substantially the same as that in prior art, description thereof is omitted. Thus, functions of the ultrasonic actuators and control operation thereof in the printing apparatus according to the present invention will be described below.

Figure 1:
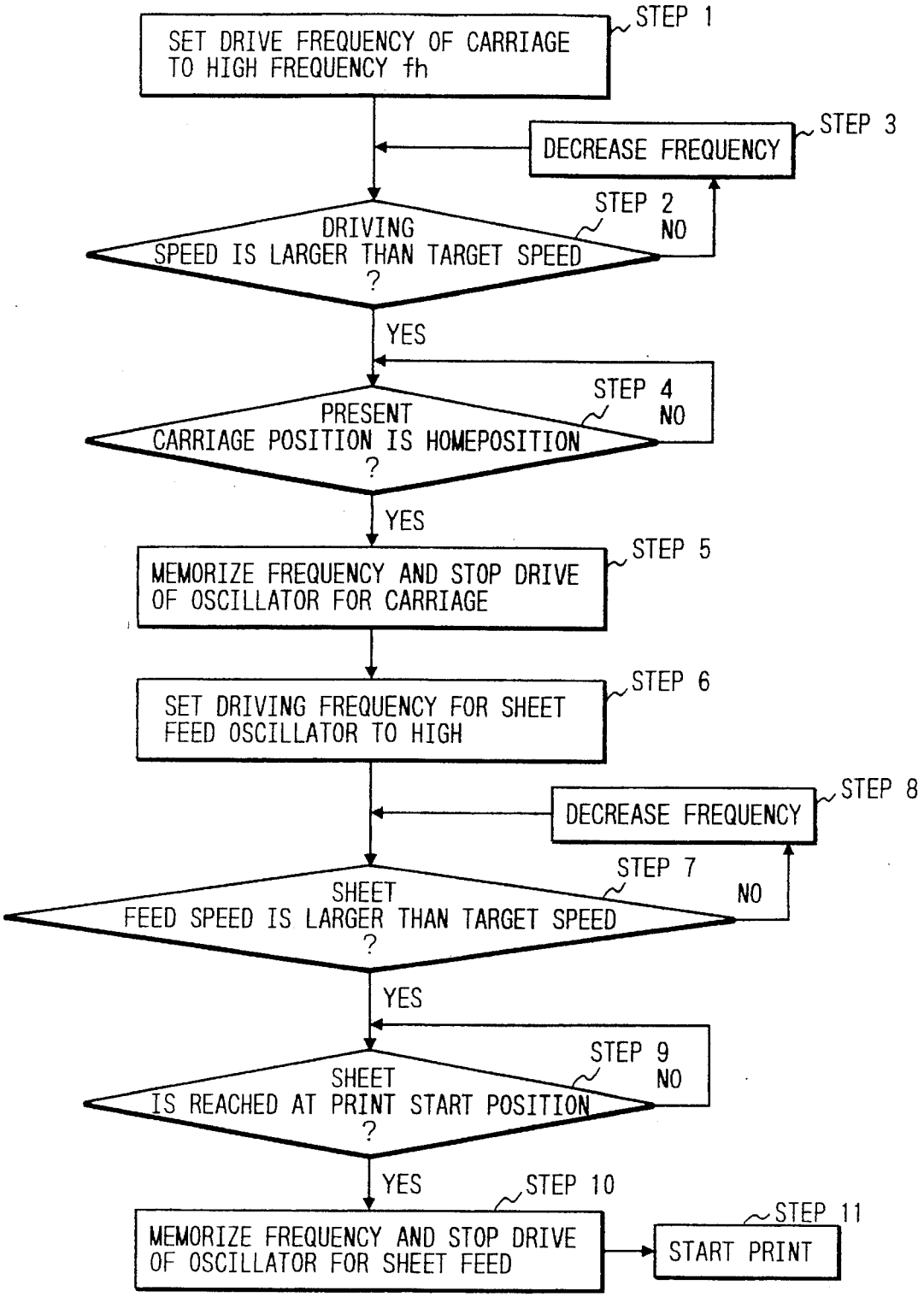
FIG. 1 is a diagram showing functions of the control means in the printing apparatus of the first embodiment according to the present invention.
Figure 5:
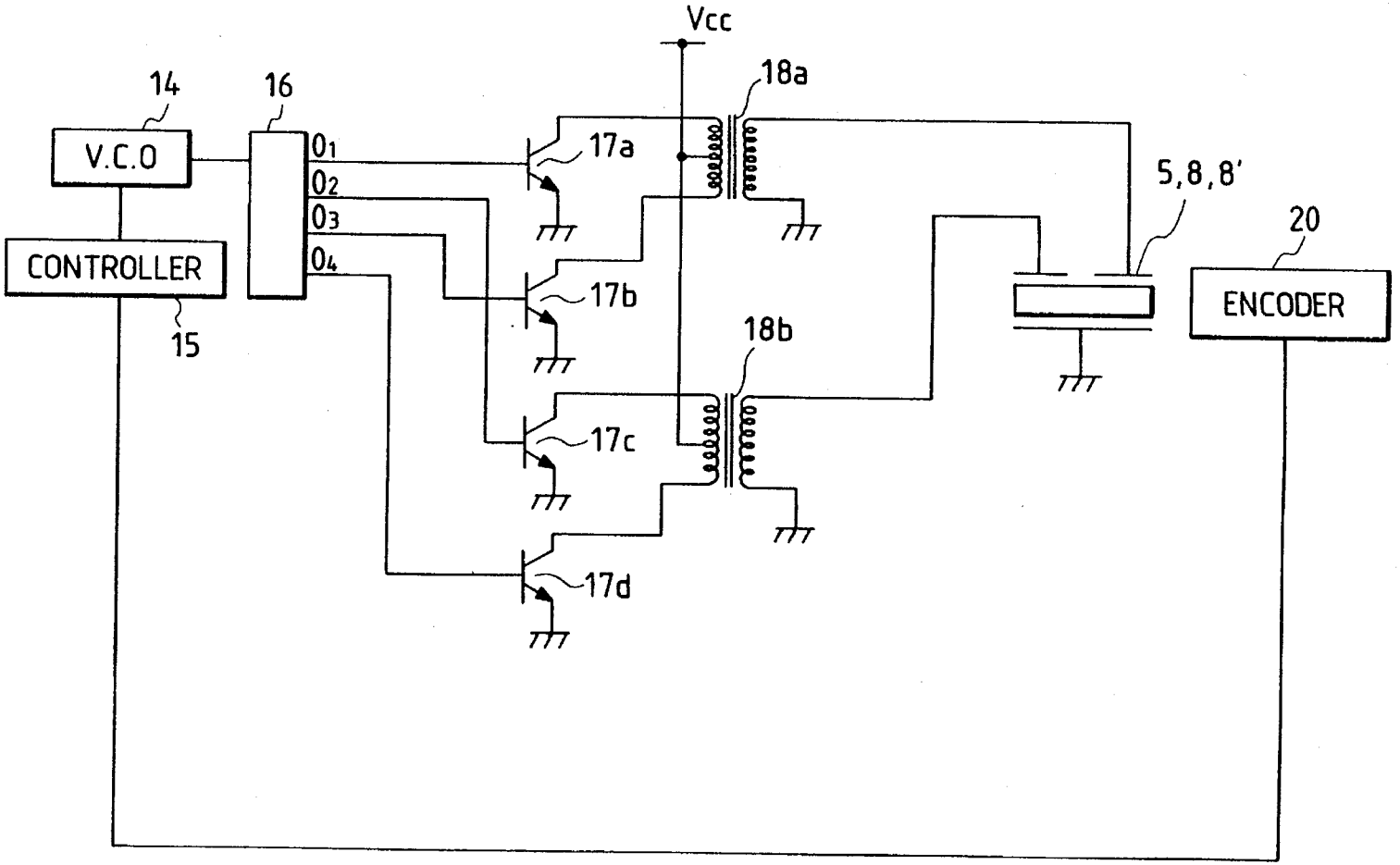
FIG. 5 PRIOR ART
FIG. 5 is a block diagram showing the control circuit for the actuators.

FIG. 1 is a flowchart of the printing apparatus of the first embodiment according to the present invention which is controlled by the ultrasonic actuator control circuit (which is substantially the same as the control device shown in FIG. 5 except the program of the controller 15) provided in the apparatus.

The functions of the thermal jet type printing apparatus of this embodiment will be described below with reference to FIG. 1.

Figure 6:
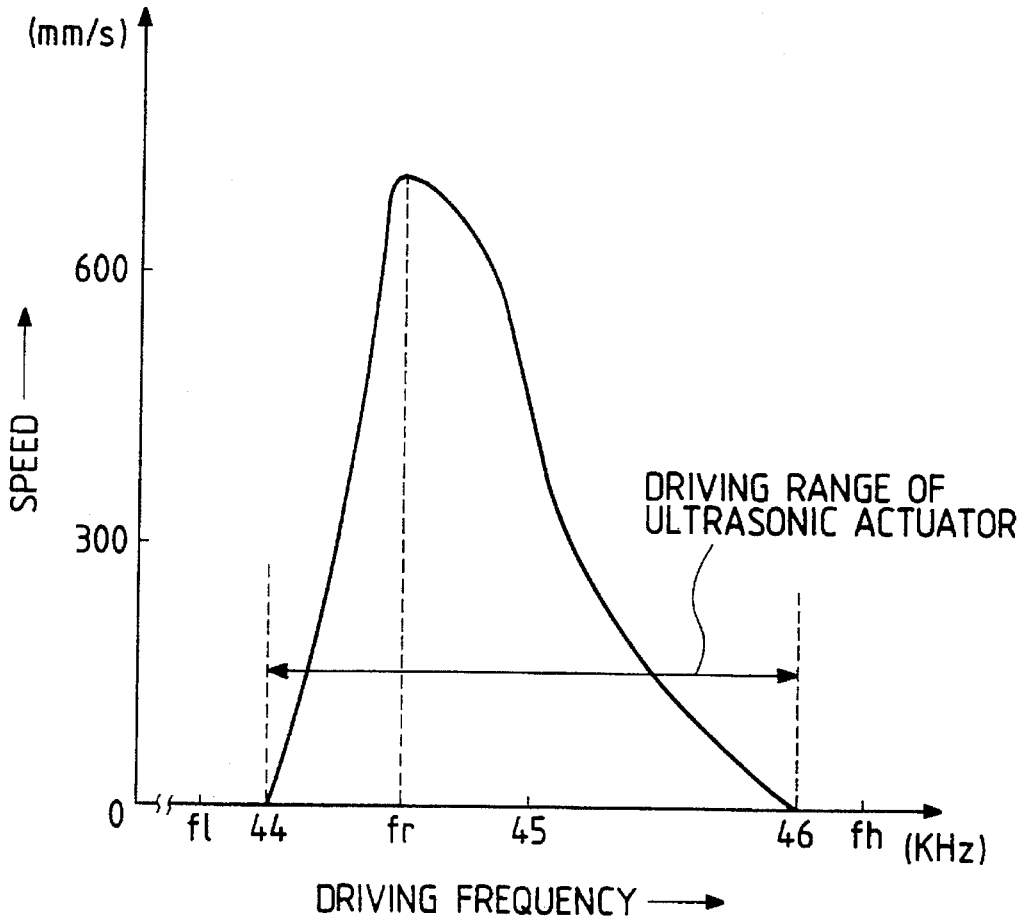
FIG. 6 is a graph showing the characteristics of the ultrasonic actuator for driving the carriage.

First, in step 1 in FIG. 1, the frequency to be applied to the ultrasonic actuator 5 (see FIG. 2) for the carriage is set to be fh shown in FIG. 6, which is closest to the resonance frequency so that no higher frequencies in the oscillation mode used for drive operation can drive the carriage of the printer regardless of any change in operational environments.

In step 2, the speed of the carriage 19 (see FIG. 2) at the present frequency is detected, thereby determining whether the detected value reaches the desired value or not. The speed of the carriage 19 is detected by linear encoder 6 shown in FIG. 2. Namely, a time in which the carriage 19 moves a predetermined amount is detected or a distance in which the carriage 19 moves during a predetermined time period is detected. As a result, the speed of the carriage 19 is determined. If not, the operation proceeds to step 3 to decrease the frequency by a predetermined value, and returns to step 2. In step 3, the frequency is decreased by changing a direct voltage to the oscillator 14 by the controller 15 shown in FIG. 5. If the detected value of the speed of the carriage is greater than the desired value, operation proceeds to step 4. Note that though, in this embodiment, the desired speed is the target driving speed of the carriage at actual print operation, it may be less than the target driving speed.

In step 4, whether the shifting carriage 19 has reached the home position or not is detected. Until the carriage 19 reaches the home position, step 4 is repeated. And when the carriage 19 reaches the home position, the driving frequency is stored in a memory in controller 15 shown in FIG. 5, operation proceeds to step 5, where the driving frequency of the carriage at the home position is memorized and the carriage 19 is stopped. The above-mentioned operation from step 1 to step 5 is substantially nothing but that of the carriage 19 which moves to the home position, wherein loss of time can be considerably avoided by properly determining the value of fh and the amount to be decreased in step 3. Note that, however, in this case, the position of the carriage 19 previous to drive (that is, previous to the regular print operation) must be somewhat distant from the home position so that the carriage 19 does not go past the home position during the steps 2 and 3.

In step 6, the actuators 8 and 8' for sheet feed are driven at a certain frequency. This "certain frequency", though not illustrated in the figures, means the frequency equivalent to fh (shown in FIG. 6) for the carriage, which is close to the resonance frequency so that no higher frequencies would move the sheet in any environments.

Figure 2:
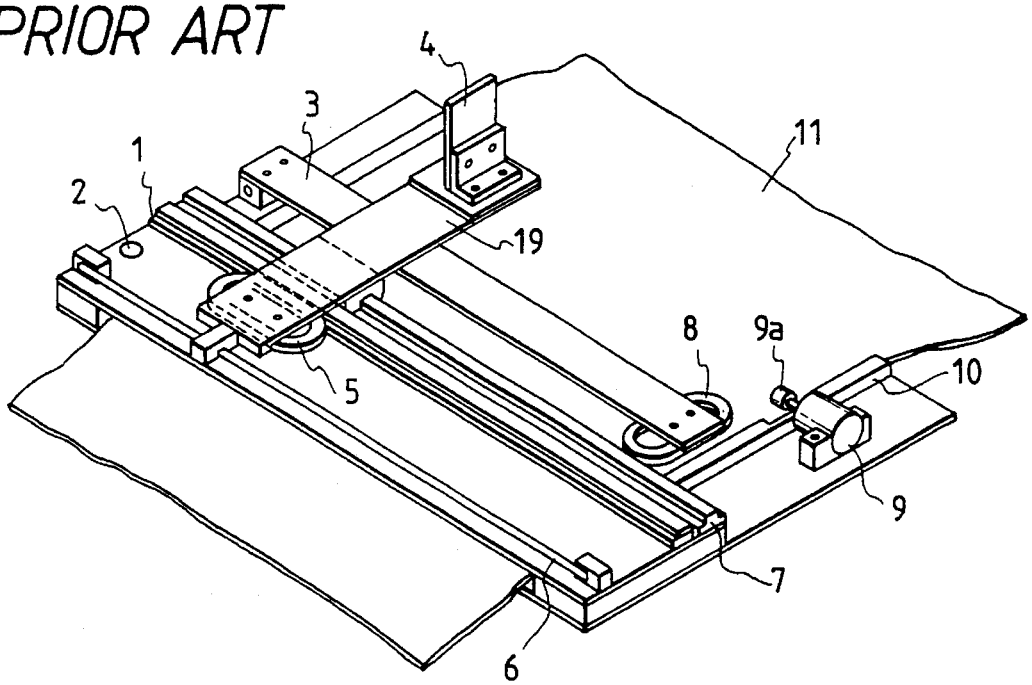
FIG. 2 PRIOR ART
FIG. 2 is a perspective view showing a printer employing ultrasonic actuators or vibration driven actuators.
Figure 3:
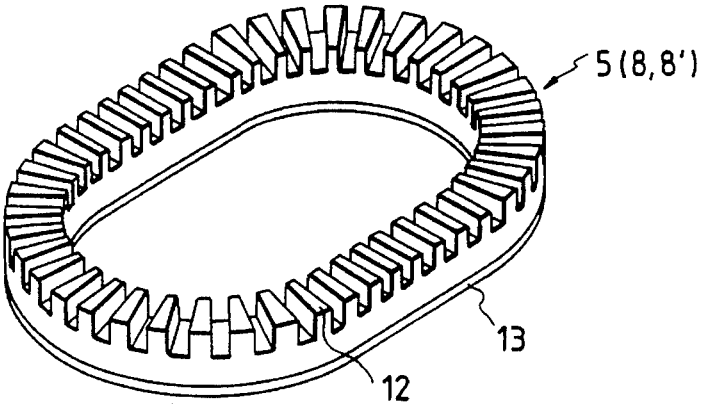
FIG. 3 PRIOR ART
FIG. 3 is a perspective view of the ultrasonic actuator.
Figure 4:
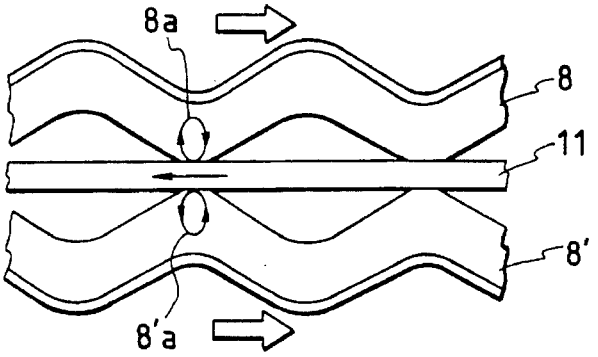
FIG. 4 PRIOR ART
FIG. 4 is an explanatory view showing the principle of sheet feed.

In step 7, the carrying speed of the sheet at the present frequency, which is detected by rotary encoder 9 shown in FIG. 2, is compared with the desired speed. If the carrying speed of the sheet is smaller than the desired speed, operation proceeds to step 8, where the frequency is decreased by a predetermined amount, and returns to step 7. The "desired speed" means the target speed of the sheet at the print operation or the "desired speed" may be less than the target speed. If, in step 7, the carrying speed of the sheet is greater than the desired speed, operation proceeds to step 9, where whether the sheet has already reached the print start position is detected by well known detecting means. Step 9 is repeated until the sheet reaches the print start position. When the sheet reaches the print start position, operation proceeds to step 10.

In step 10, the driving frequency of the sheet at the print start position is stored in memory and the drive of the actuators 8 and 8' for sheet feed is stopped. And operation proceeds to step 11, where the print operation is performed. During the print operation, the actuators 5, 8, and 8' are driven at the frequency memorized in steps 5 and 10 and after that the frequency is controlled by the speed-detected by encoder.

The above-mentioned operation from step 6 to step 10 is substantially nothing but that of the sheet which moves to the print start position, that is, the sheet feeding operation, wherein loss of time can be reduced by properly determining the frequency employed in step 6 and the amount of change in the frequency in step 8.

The above operation shown in FIG. 1 for detecting the characteristics of the actuator 5 for the carriage and the actuators 8 and 8' for sheet feed is substantially the same as that of the carriage moving to the home position and that of the sheet moving to the print start position, that is, the regular initial operation of the printer before the normal print operation.

Figure 7:
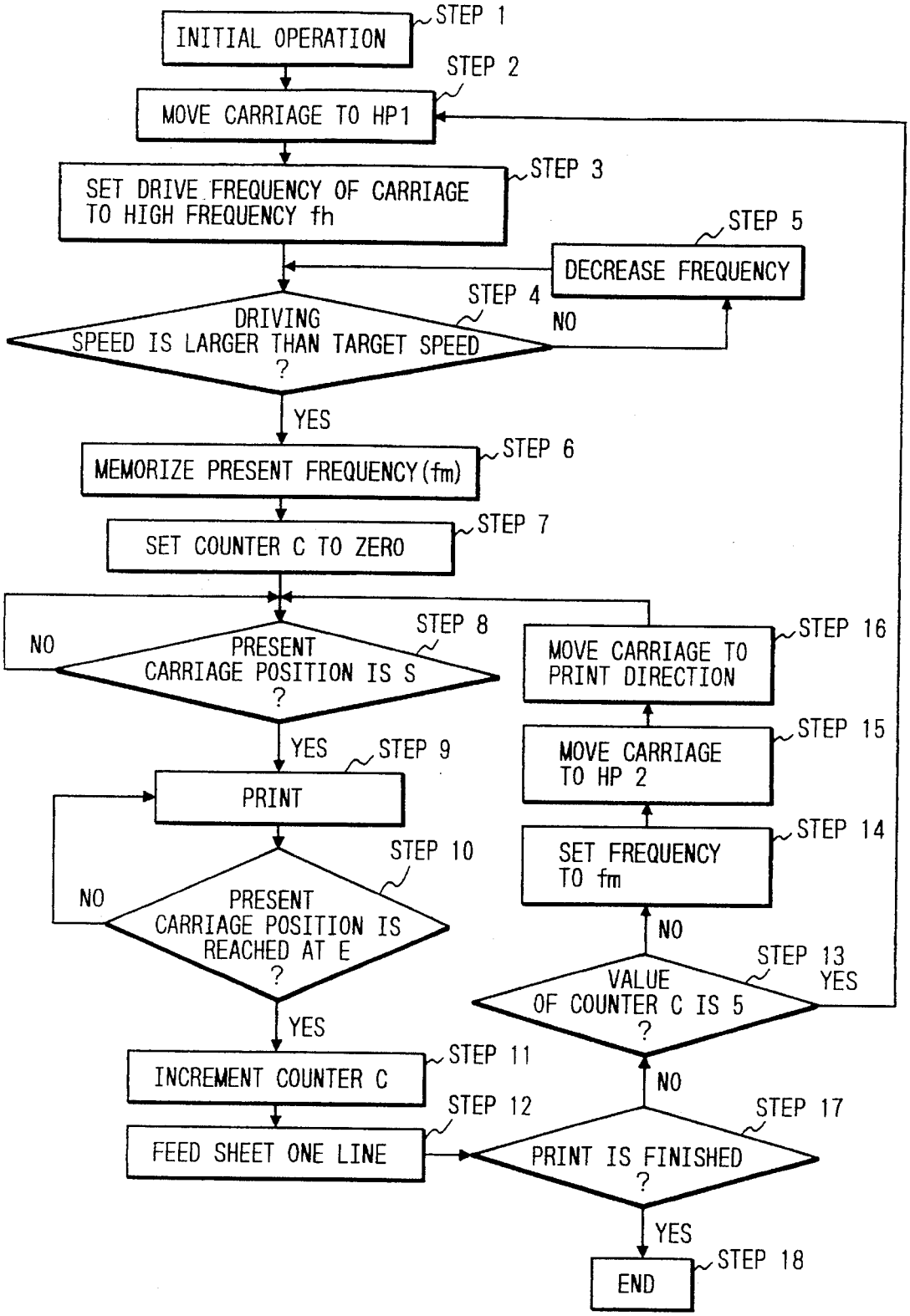
FIG. 7 is a diagram showing functions of the control means in the printing apparatus in another embodiment according to the present invention.

Next, operation of another embodiment of the printing apparatus according to the present invention which is controlled by the ultrasonic actuator control circuit provided in the apparatus will be described with reference to FIGS. 7 and 8. The same elements in this embodiment as those in the printer shown in FIG. 2 will not explained here.

In the first embodiment, home position 2 in FIG. 2 is a single position. In this embodiment, as shown in FIG. 8, two home positions (HP1 and HP2) are provided within the moving range of the carriage. In the figure, symbol S indicates the head (start) of a line, and symbol E indicates the end of the line.

Figure 8:
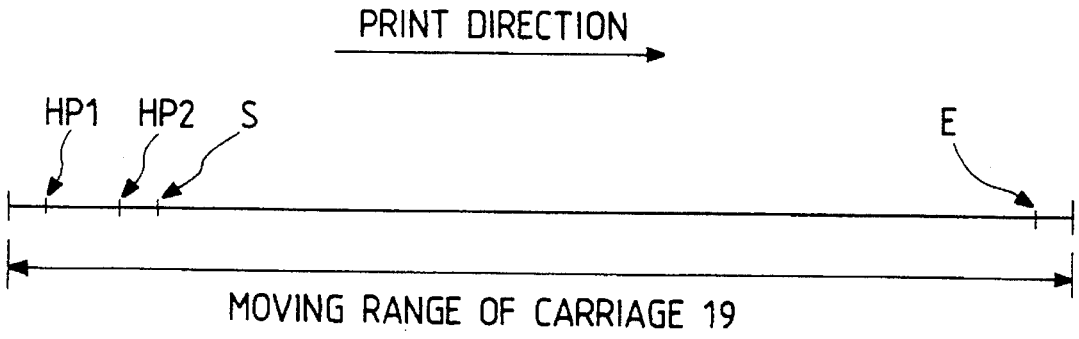
FIG. 8 is a view for explaining the positions of the carraige in the embodiment of FIG. 7.

As the speed of the carriage 19 (see FIG. 2) must be constant during the print operation, the speed should be fully built up by when the carriage 19 reaches point S shown in FIG. 8. When the actuator 5 (see FIG. 2) for driving the carriage is driven at the optimal frequency, the speed of the carriage is fully built up from HP2 to the line head S, wherein the distance therebetween is the shortest build-up distance in this apparatus. In this embodiment, the frequency capable of realizing the shortest build-up distance is detected after every five lines of print operation. Operation will be described below in detail with reference to FIG. 7.

In step 1, preparatory operation of the printer as moving the sheet to printing start position and the like is performed. Then, in step 2, the carriage 19 is moved to HP1 shown in FIG. 8. Subsequently, in step 3, the driving frequency of the carriage 19 is set to be fh in FIG. 6, wherein the travelling direction of the carriage 19 should coincide with the print direction shown in FIG. 8. Next, in step 4, the speed at the present frequency is detected and compared with the target speed. If the detected speed is smaller, operation proceeds to step 5 to decrease the frequency by a predetermined amount, and returns to step 4. If the speed detected in step 4 has reached the target value, the present frequency is memorized and defined as fm in step 6. Steps 3 to 6 may serve as a first operation.

Next, in step 7, the value of the counter C for counting the lines (contained in the controller 15 comprising a microcomputer) is set to be 0. In step 8, whether the carriage 19 (see FIG. 2) has reached the line head S or not is examined. If the carriage has reached the line head S, the print operation is performed in step 9. The driving frequency is adjusted during the print operation according to the speed detected from the encoder 6 for the carriage so that the speed of the carriage 19 is kept constant. A moving speed of the cartridge 19 is detected based on output information of the encoder 6. The frequency is increased when the speed is faster than the predetermined desired speed, and the frequency is decreased when the moving speed is slower than the predetermined desired speed, and the moving speed of the carriage 19 is controlled so as to coincide with the desired speed. When the carriage 19 reaches the line end E, the carriage is stopped in step 10, and the value of the counter C for counting the lines is increased in step 11. Then, in step 12, the sheet is fed by one line, and whether the print operation is finished or not is examined in step 17. If it is not finished, operation proceeds to step 13.

In this embodiment, as described above, the characteristics of the actuator 5 for the carriage are detected after every five lines of print operation. Accordingly, when the value of the counter C for counting the lines reaches 5 in step 13, the carriage is shifted to HP1 (FIG. 8) and the above-mentioned detecting operation is performed. If the value of the counter is not 5, the previously detected frequency fm is set in step 14. In step 15, the carriage 19 is shifted to HP2. And in step 16, the above-mentioned print operation which proceeds to further steps is started. Therefore, only the short distance from HP2 to S is required to build up the speed of the carriage 19, and the print operation can be performed smoothly. Steps 14 to 16 may serve as a second operation.

In this embodiment, the carriage 19 is driven from HP1 when the characteristics are detected, because the driving frequency is gradually decreased from fh to perform detection and a longer distance is required to build up the speed.

As described above, in the printing apparatus according to the present invention, operation for detecting the characteristics of the actuators is performed in advance during the initial operation of the printer in order to realize stable operation of the actuators regardless of change in the resonance frequency of the ultrasonic actuators due to change of environments such as temperature. Therefore, as loss of time necessary for detection is avoided and additional circuit for detection is not required, the cost is low.

Incidentally, though, in the above embodiments, the characteristics of the actuators are detected while the carriage returns to the home position or while the sheet feeding operation is performed and the result of the detection is used during the regular print operation, detection of the characteristics of the actuators may be performed during operation other than that described above; for example, during operation for cleaning the printing head 4 or operation for opening a cap to be ready for bubble discharge.

What is claimed is:

1. A moving device, comprising:

a moving member;

a vibration driven actuator serving as a driving source for driving said moving member, said actuator having various characteristics effecting the moving speed of said moving member;

means for providing a driving frequency to said actuator; and control means for detecting at least one of said characteristics effecting the moving speed of said moving member at a first operation before said moving member starts to execute a second operation, and for controlling said means for providing a driving frequency in response to the at least one detected characteristic to obtain a desired moving speed of said moving member after the start of the second operation, wherein the moving speed is changed by changing the driving frequency.

2. A device according to claim 1, wherein said control means includes a circuit element controlled by a program.

3. A device according to claim 1, wherein said control means detects, in the second operation, an actual difference between the moving speed of said moving member and a target speed, and controls the driving frequency so that said moving member moves with said target speed.

4. A device according to claim 2, wherein said control means detects, in the second operation, an actual difference between the moving speed of said moving member and a target speed, and controls the driving frequency so that said moving member moves with said target speed.

5. A device according to claim 2, wherein said control means stores a relationship between the moving speed of said moving member and the driving frequency at the first operation.

* * * * *

UNITED STATES PATENT AND TRADEMARK OFFICE

CERTIFICATE OF CORRECTION

PATENT NO. : 5,588,758

DATED : December 31, 1996

INVENTOR(S) : Shinji YAMAMOTO

It is certified that error appears in the above-indentified patent and that said Letters Patent is hereby corrected as shown below:

TITLE PAGE, [30]:

"Jun. 25, 1993" should read --Jun. 25, 1992--.

COLUMN 1:

Line 51, "detect" should read --detects--.

COLUMN 3:

Line 45, "carraige" should read --carriage--.

COLUMN 4:

Line 32, "memorized" should read --stored in memory--.

COLUMN 5:

Line 3, "memorized" should read --stored in memory--;
Line 11, "speed-detected" should read --speed detected--.

Signed and Sealed this

Twenty-ninth Day of July, 1997

Bruce Lehman

*Attest:*

BRUCE LEHMAN

*Attesting Officer*

*Commissioner of Patents and Trademarks*